US005474300A

United States Patent [19]

Scalise et al.

[11] Patent Number: 5,474,300

[45] Date of Patent: Dec. 12, 1995

[54] TRAINING GOLF CLUB FOR PUTTING

[76] Inventors: Patrick A. Scalise; Craig C. T. Marshall, both of 1129 ½ Horn Ave., West Hollywood, Calif. 90069

[21] Appl. No.: 313,737

[22] Filed: Sep. 27, 1994

[51] Int. Cl.[6] ..... A63B 69/36

[52] U.S. Cl. ..... 273/193 B; 273/81.3; 273/81 C

[58] Field of Search ..... 273/193 B, 81.3, 273/81 C, 77 R, 186.2, 187.4, 187.5

[56] References Cited

U.S. PATENT DOCUMENTS 2,445,718 7/1948 Sternberg et al. ..... 273/193 B 5,088,738 2/1992 Mundt et al. ..... 273/193 B

*Primary Examiner*—George J. Marlo

*Attorney, Agent, or Firm*—Antonio M. Fernandez

[57] ABSTRACT

A putter is disclosed for use in training a golfer in a style of putting in which a crossrod at the upper end of the club shaft is provided with a sleeve supported at each end by ball bearings on a reduced diameter portion thereof extending from the shaft toward the golfer while the golfer addressed a ball. The golfer maintains a firm grip on the sleeve with one hand during the backswing and the ensuing pendulum-like stroke while using the other hand to grip a portion of the crossrod that extends out away from the golfer in order to raise the club head to a desired height during the backswing, after which that portion is released or held with a light grip should the golfer want to add more power for a longer and/or uphill putt. The golfer may thus maintain his body steady during the putting stroke for greater consistency in putting on the green in the course of play.

2 Claims, 1 Drawing Sheet

TRAINING GOLF CLUB FOR PUTTING

FIELD OF THE INVENTION

The invention relates golf clubs for putting on the greens, and more particularly to a training golf club device for putting.

BACKGROUND OF THE INVENTION

The importance of putting in the game of golf is well understood. In an eighteen-hole golf course, the distance from one hole (green) to another varies. As a consequence, the number of strokes allocated to each hole as "par" varies from a minimum of three to a maximum of five or six. The minimum number of strokes allocated for any given hole will include one from a tee and two on the green. Any additional strokes included as par for a hole are to be taken from the fairway to reach the green. Consequently, for a par game, the player must reach a par-three hole in one stroke from the tee, a par-four hole with one stroke from the fairway, and a par-five hole with two strokes from the fairway. The net result is that for a par of 72 (for an eighteen-hole golf course), the average number of strokes allocated is four, of which half are allocated to putting. After reaching the green, one putting stroke is usually needed to lay the ball up close to the cup, even though one always shoots for the cup on the first putt but most often does not make the cup. A second stroke is then needed to put the ball in the cup in order to make par for the hole.

In both professional and amateur competition, as well as for individual recreational play, the object of the game is to complete the course with a total number of strokes as much under par as possible, and since the average number of putting strokes allocated for each hole to complete the course is two, it is very important to achieve a high level of consistency on the putting green. An object of this invention is therefore to provide a golf club for training a golfer in a particular style of putting that approximates a pendulum swing of the club in order to achieve a high level of consistency in putting on the green during the course of play.

STATEMENT OF THE INVENTION

In accordance with the present invention, a training golf club for putting on a green comprising a shaft and a club head is provided with a crossrod at the upper end of the shaft with the axis of the crossrod approximately perpendicular to the shaft. The axis lies in a plane parallel to the face of the golf club head when the golf club training device is held upright by the golfer in addressing a ball, but since the golfer will address the ball with the shaft tilted toward him by a small angle, the axis of the crossrod will slope downwardly toward the golfer by a corresponding angle.

The golf club training device is further provided with a sleeve supported by bearings on a rear portion of the crossrod extending between the shaft and the golfer (i.e., extending in a direction of the heel of the club head) by means for reducing friction, such as ball or roller bearings, so that when the golfer holds the sleeve steady in space, the shaft and head may swing freely in space like a pendulum. A forward portion of the crossrod extends from the shaft away from the golfer (i.e., extending over the club head in the direction of its toe) to allow the golfer to use his other hand to assist in holding the axis of the crossrod steady in space. In order for the pendulum-like swing to take place about the axis of the crossrod, the forward portion is held loosely by the other hand during the downswing, but is to be gripped tightly during the backswing to raise the club head to a desired height.

To execute the stroke, the other hand releases its tight grip on the forward portion of the crossrod but maintains a loose grip during the downswing, or a light grip if the golfer wants to add some power to the downswing for a longer putt. In any case, a tight grip is maintained with a steady hand on the sleeve at all times.

The novel features that are considered characteristic of this invention are set forth with particularity in the appended claims. The invention will best be understood from the following description when read in connection with the accompanying drawings.

DESCRIPTION OF PREFERRED EMBODIMENTS

Figures 1, 2, 3, 4:
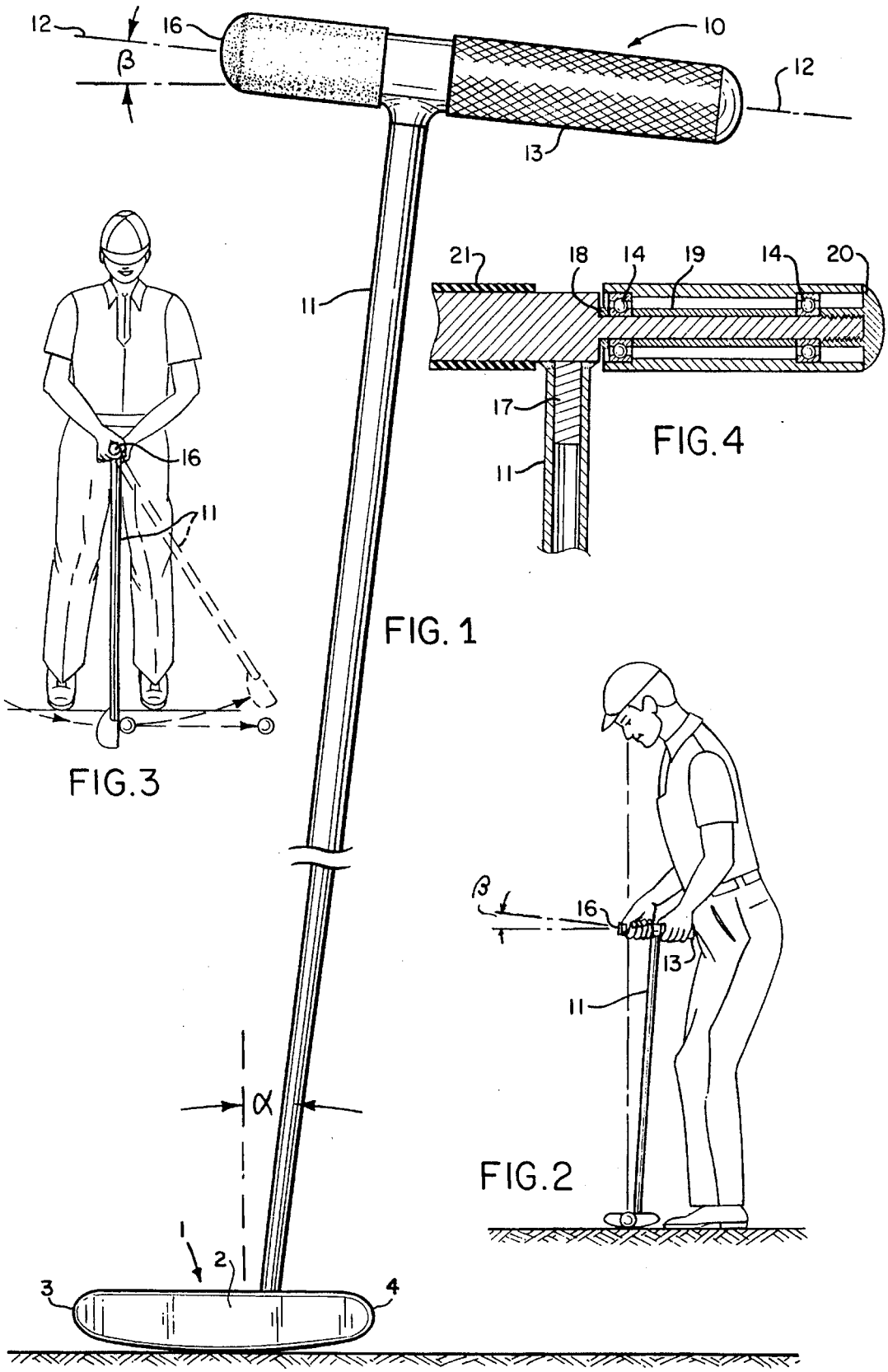
FIG. 1 illustrates a front elevational view of a golf club training device for putting.
FIGS. 2 and 3 illustrate a golfer using the device of FIG. 1.
FIG. 4 illustrates a cross section of a crossrod at the upper end of the shaft of the golf club training device shown in FIG. 1.

In accordance with the present invention, a golf club for putting having a head I with a striking face 2 between the toe 3 and heel 4 thereof is attached to a crossrod 10 at the upper end thereof as shown in FIG. 1. The crossrod thus replaces the usual grip portion of the shaft. At least half of the crossrod 10 extends rearwardly toward the golfer with its axis in a plane of the shaft that is parallel to a vertical plane passing through a horizontal line on the face 2 of the head 1 between the toe 3 and the heel 4 thereof, as shown in FIG. 2, and the balance of the crossrod extends forward, away from the golfer while addressing a golf ball shown in FIG. 3. While the golfer addresses the ball, the axis 12 of the crossrod is perpendicular to the intended line the ball is to travel, at least initially upon being stroked as shown in FIG. 3. A sleeve 13 placed over that portion of the crossrod extending rearwardly toward the golfer is supported at each end by bearings 14 that reduces the friction of motion between the sleeve and the crossrod, such as ball bearings as shown in FIG. 4 so that when the golfer grips the sleeve 13 in a rigid manner with one hand, for example the left hand of a right-handed golfer, the golf club 11 may swing freely like a pendulum about the axis of the crossrod.

The portion 16 of the crossrod extending away from the golfer is initially gripped by the other hand (the right hand of a right-handed golfer) to so turn the crossrod about its axis as to effect a back swing of the club head. Releasing that grip of the right hand will then allow the putter to swing down and through the golf ball like a pendulum as illustrated in FIG. 4 with a force dependent upon the height of the club head at the end of the back swing. That force will be sufficient for normal distances of less than eight to ten feet. For putting over longer distances, the other hand on the forward portion 16 can be used to add some force to the otherwise free swinging club during the downswing without detracting from the principle being taught, namely to swing the golf club freely as a pendulum as opposed to a soft, body-powered stroke achieved through the use of the golfer's body and arms.

The intent is to use the golf club shown in FIG. 1 as a training device for putting, i.e., to stroke the ball using a free pendulum-like swing of the putter without any body motion, such as the arms or rotation of the shoulders and hip. Instead, the golfer learns to hold his elbows close to or tight against the sides of his torso, as illustrated in FIG. 3, and to concentrate on having the putter fall freely in a pendulum-like swing about the axis 12 fixed in space by his steady hands such that the arc of the club head travel passing through the position of the ball on the green is in a plane passing through the intended line of initial travel for the ball. On a flat and level green, that line of initial travel will be along a straight line between the ball and the hole, but as golfers know, some deviation of the line of initial travel may be required to be along a straight line passing on either side of the cup a distance just enough to compensate for the tendency of the ball to roll off its initial course due to slope of the green, which tendency is a function of the degree of slope, distance and initial velocity of the ball after it is stroked.

The degree of such compensation required in the initial line of travel is determined by experience, but once the degree is determined it is readily set with the device of the present invention by having the golfer position both feet on a base line parallel to the intended initial line of ball travel. This degree of compensation is readily maintained by positioning the axis 12 of the crossrod perpendicular to the base line of his feet. The golf club training device of this invention will then provide the golfer with the look and feel of a pendulum-like putting stroke which he can then seek to maintain using a conventional golf club for putting on the green. Once that motion is learned, it is easily adapted to a conventional putter, i.e., a putter having a coaxial grip.

In assembling the crossrod 10, a stub 17 is welded in a position approximately perpendicular to it. That stub is then press-fitted into the end of the hollow shaft 11. The end of the shaft may then be pinned or welded to the crossrod if desired, or simply secured with epoxy. Before fitting the sleeve 13 over a reduced diameter portion of the crossrod, a washer 18 is fitted over the reduced diameter portion. Then one bearing 14 is slipped over that reduced diameter portion followed by a spacer 19 comprising a section of tube between the first, inner bearing 14 and the second, outer bearing 14. Once the outer bearing is in place with the spacer 19 between the two bearings, the sleeve 13 is press-fitted over the outer race of the bearings. The sleeve may be provided with a thicker wall at the right end as shown in FIG. 4 to assure that when press-fitted over the bearings there will be a gap between the left end of the sleeve and the portion of the crossrod that is not reduced in diameter as shown in FIG. 4.

The outer end of the reduced diameter portion of the crossrod shown to the right in FIG. 4 is threaded to receive a capping end piece 20 that bears against the assembly of washer 18 and bearings 14 with spacer 19 between them. The end piece 20 is essentially a nut of sufficient threaded length with a domed end. The domed end has a diameter approximately equal to the outer diameter of the sleeve 13.

The portion 16 of the crossrod 10 opposite the sleeved end may be equipped with a press-fitted sleeve 21 of rubber or similar resilient material to facilitate griping and turning the crossrod 10 about it axis 12. The sleeve 13 may also be fitted with a similar of resilient material or knurled to facilitate the golfer in maintaining a firm grip on the sleeve.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. A training golf club for putting on a green comprising a club head having a ball striking face between the toe and heel thereof, a shaft extending upwardly from said club head, a unitary crossrod affixed to the upper end of said shaft with the axis of said crossrod in a plane of the shaft that is parallel to a vertical plane passing through a horizontal axis on the face of said head between the toe and heel thereof, said crossrod having a first portion extending in said plane of said shaft in a rearward direction over said heel, and a second portion including a gripping means extending in said plane of said shaft in a forward direction over said toe, and a coaxial sleeve supported on said first portion of said crossrod by means for reducing friction of pendulum motion between said crossrod and said sleeve while their common axis is held steady in space by one hand of a golfer firmly gripping said first portion at all times, and the other hand of said golfer firmly gripping said gripping means of said second portion only in a backswing to raise said club head in preparation for a downswing with pendulum motion by turning said crossrod about said common axis, and loosely holding said second portion during said downswing to allow said pendulum motion.

2. A training golf club for putting on a green comprising a shaft and a club head having a face for striking a ball affixed to one end of said shaft and a unitary crossrod affixed approximately perpendicular to said shaft at the other end opposite said club head, said crossrod being affixed with its axis in a plane parallel to said striking face, said shaft being affixed to said head at a small angle a with respect to a vertical axis that is perpendicular to a horizontal reference plane under said club head placed on the green in addressing said ball, thereby positioning said crossrod at a correspondingly small angle $\beta$ such that one portion thereof tilts downwardly from said shaft toward the golfer while said training golf club is in use and another portion thereof tilts upwardly from said shaft away from said golfer, and a coaxial sleeve supported on said one portion of said crossrod by means for reducing friction of motion between said crossrod and said sleeve with their common axis held steady in space by one hand of said golfer firmly gripping said sleeve at all times in the backswing and downward swing through the ball during a stroke and by the other hand of said golfer firmly gripping said other portion of said crossrod during the backswing in order to turn said crossrod on its axis to raise said club head from said reference plane a desired height in preparation for a pendulum-like stroke executed by releasing the firm grip of said other hand.

* * * * *